United States Patent [19]

Bond

[11] 4,064,780

[45] Dec. 27, 1977

[54] STRINGED INSTRUMENTS

[76] Inventor: Andrew Bond, 38 Courthill Road, Parkstone, Poole, Dorset, England

[21] Appl. No.: 605,502

[22] Filed: Aug. 18, 1975

[30] Foreign Application Priority Data

| | | |
|---|---|---|
| Nov. 26, 1974 | United Kingdom | 51247/74 |
| May 29, 1975 | United Kingdom | 23464/75 |

[51] Int. Cl.[2] ..... G10D 3/06; G10D 3/04

[52] U.S. Cl. ..... 84/314; 84/298; 84/307

[58] Field of Search ..... 84/314, 293, 306, 307, 84/298

[56] References Cited

U.S. PATENT DOCUMENTS

| | | | |
|---|---|---|---|
| 463,954 | 11/1891 | Middlebrooke | 84/314 |
| 1,188,983 | 6/1916 | Nonfris | 84/314 |
| 1,253,550 | 1/1918 | Wilkins | 84/314 |
| 1,472,943 | 11/1923 | Shaeffer | 84/314 |
| 1,475,345 | 11/1923 | Lambert et al. | 84/314 |
| 2,469,582 | 5/1949 | Strong | 84/293 |
| 2,816,469 | 12/1957 | Gossom | 84/314 |
| 2,959,085 | 11/1960 | Porter | 84/314 |
| 3,443,467 | 5/1969 | Richards | 84/314 |
| 3,481,238 | 12/1969 | Veres | 84/314 |
| 3,787,600 | 1/1974 | Muncy | 84/314 |

FOREIGN PATENT DOCUMENTS

| | | | |
|---|---|---|---|
| 1,140 of | 1776 | United Kingdom | 84/314 |

*Primary Examiner*—Stephen L. Tomsky
*Attorney, Agent, or Firm*—Cushman, Darby & Cushman

[57] ABSTRACT

A stringed instrument having a fretboard with a saw-tooth surface profile with the crests of the teeth in the normal fret positions.

Optionally the instrument may have a rotatable nut of generally cylindrical form having a plurality of annular grooves therein, one groove for each string of the instrument. The nut is so mounted or the grooves are so shaped that on rotation of the nut, the heights of the strings from the surface of the fretboard are varied simultaneously.

16 Claims, 16 Drawing Figures

FIG. 6.
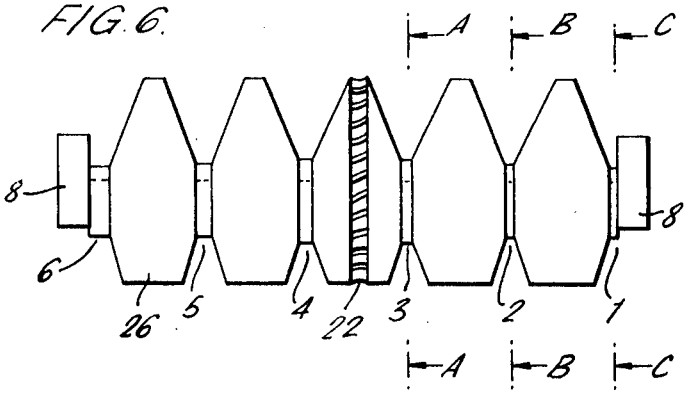
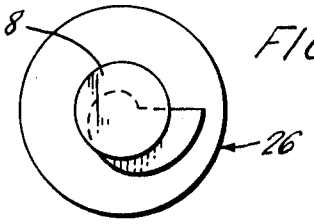
FIG. 7.
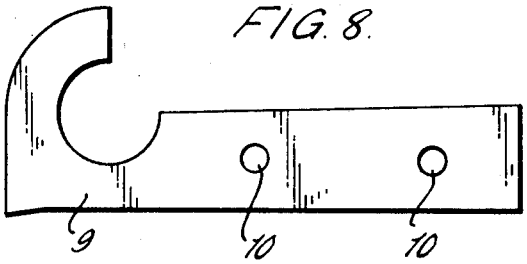
FIG. 8.
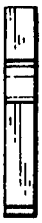
FIG. 8A.

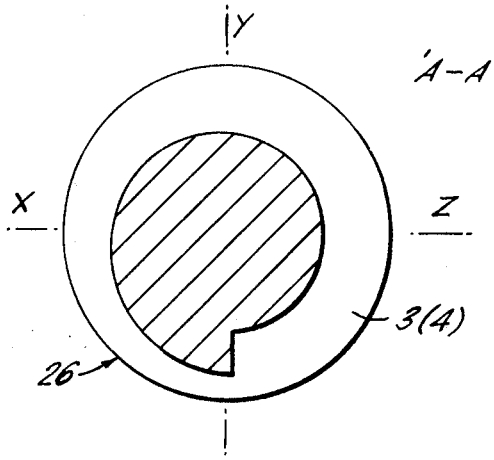
'A-A' FIG. 9.
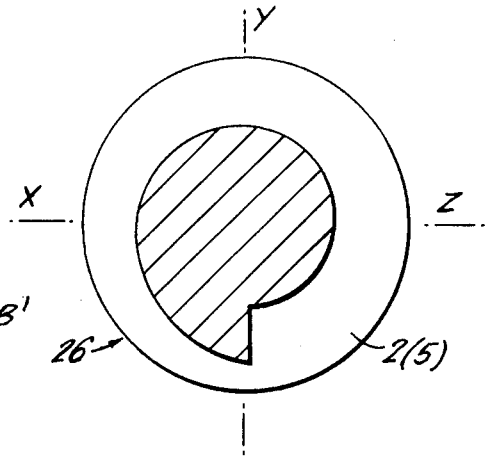
FIG. 10. 'B-B'
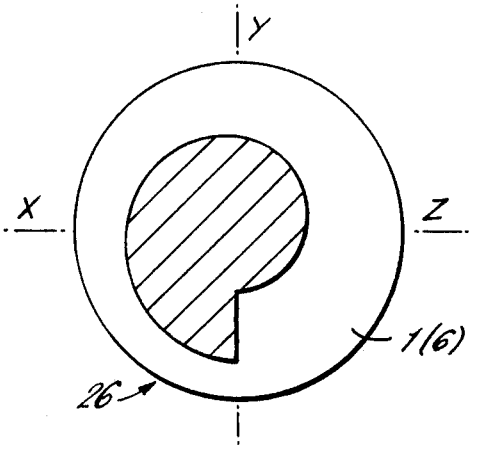
'C-C' FIG. 11.

STRINGED INSTRUMENTS

The present invention relates to stringed instruments and particularly to guitars. For convenience of description reference will be made to guitars, but it is to be understood that this term is intended to include other stringed instruments.

A guitar comprises a body, a head and a neck interconnecting the head and body. A plurality of frets are mounted transversely at spaced intervals along a fingerboard or fretboard secured to the neck and extending over the surface of the sound table to the sound hole. Strings extend from a bridge, over a saddle, along the neck and over a nut mounted at the junction of the neck and head to separate machine heads which are used for retaining and tensioning the strings.

When a guitar is played, the strings are pressed down by the fingers towards the fingerboard until they meet the frets and/or fretboard so that when the string is vibrating it will produce a note of the required pitch or frequency. This note should be accurate to within an error which the human ear cannot detect and should be free of spurious noises (e.g. rattle and buzzing) which are not directly related to the production of the required pitch or frequency and its harmonics.

The main factors which affect the notational accuracy and the amount of spurious noise are as follows:

1. The height of the strings above the fretboard.

If the height of the strings above the fretboard is too low, the vibrating string will knock against the frets between where it is being pressed down and the bridge; this produces an unwanted buzz or rattle. If the string is too high, the time taken to press the string down onto the fretboard will be undesirably long and it will make the guitar slow and difficult to play. Also the string will be stretched when depressed to the fretboard which will result in an increase in tension and a consequent raising of the pitch of the note.

If the string is plucked gently as in finger picking, the minimum height of the strings may be less to avoid buzz and rattle, than if the strings are being strummed when they will vibrate more strongly.

2. The longitudinal flatness of the fretboard.

The longitudinal flatness of the fretboard is important because it affects the minimum height of the strings than can be used without rattle. If the fretboard curves or twists along its length the height of the strings is determined by the minimum height above the highest points of the curves or twists, and because of the irregularity it is much more difficult to play.

To prevent the fretboard from curving, many guitars have a metal rod or "truss rod" set at a slight angle to the fingerboard inside the neck to compensate for the upward pull of the strings. In practice the truss rod needs constant adjustment and is only partially effective.

3. The surface profile of the fretboard.

The surface profile of the fretboard affects notational accuracy and also the ease of play. When a string is pressed onto a fret, which protrudes from the fretboard, it will produce one note, but if it is pressed down harder onto the fretboard behind the fret, it will be stretched over a longer distance and the resulting increase in the tension of the string will cause the pitch or frequency of the note to be raised by an audible amount.

Therefore it is desirable to have as low a fret height as possible, but the lower the fret height the faster the fret will wear out.

4. The Position of the fret relative to the scale length.

This determines the frequency of the notes obtained when the guitar is played; if the frets are wrongly positioned the guitar will not play in tune.

As well as having the greatest possible notational accuracy and the minimum of spurious noise, a fretboard should have as long a working life as possible maintaining these characteristics and it should also be easy to play and offer maximum comfort to the player.

Conventional fretboards are made from hard wood, with frets of nickel-silver or other material. The neck is made of wood and the truss rod is metal. The nut is plastics or bone, with grooves cut in the top for the strings, and it determines the height of the strings above the fretboard in conjunction with the bridge saddle.

The disadvantages of this design are as follows.

The height of the strings above the fretboard is permanently fixed by the nut, and only slight alteration can be obtained by altering the saddle height at the bridge. This means that the string height is best for either finger picking or strumming, or else it may be set for Hawaiian style (bottleneck) where the strings should be about a quarter of an inch from the fretboard and also in a flat plane rather than following the curvature of the fretboard. Therefore the player is restricted to playing in the manner for which the guitar is set or must settle for a compromise.

As the neck and fretboard are made from wood, and are being subjected to the pull of the strings, they tend to bend or twist and therefore cause the height of the strings above the fretboard to increase, which is undesirable. Also, as the humidity and temperature of the wood changes, so further stresses are set up and increase this effect. Due to these changes, although the fretboard may start off straight, the straightness does not last and usually needs lengthy repairs.

Further the fret material is, of necessity, a soft metal and therefore it is subject to a high rate of wear. As the frets wear so the profile flattens and produces a condition wherein the frequency can increase by a quartertone to a semitone in the pitch of a note selected.

In one aspect of the present invention, there is provided a fretboard for a stringed instrument, the fretboard having a sawtooth profile, such that the crests are in the normal fret positions. The more vertical faces of the crests face towards the body of the guitar and the opposite face slopes back to the base of the fret behind. This is in order to reduce to a minimum the frequency deviation caused when the string is fretted, and also to reduce the opposition to the fingers when the hand is being moved rapidly up the fretboard.

In the present specification it is to be understood that by "sawtooth shape" is meant a substantially triangular shape having its base formed by the body of the fretboard, a relatively short side inclined substantially at right angles to the base and a relatively long, planar side extending from the top of the short side to the bottom of the short side of the next following ridge in the direction of the head end of the fretboard.

The fretboard should preferably be made of a light, strong substance with a hard surface, so that it will not wear in use, nor bend or twist under the tension of the strings. Suitable substances may be high impact plastics, magnesium alloy, aluminum alloy with a hard anodised surface, plastics or aluminum alloy with hard strips set into the crests of the ridges, e.g. tungsten carbide; or any other suitable substance which may be either machined, cast, moulded or a combination of these. The front face of the frets may be marked in a different colour of hard anodising or by any other method for ease of fret identification.

The fretboard may be screwed or glued to the neck in the conventional manner. If desired, an elongate stiffening bar may be formed in the underside of the fretboard, being located in a groove formed in the neck of a guitar to which it is fitted.

Further the elongate stiffening bar may be made in a male dovetail form, and the slot in the neck may be made in a female dovetail form. If the female is tapered slightly at the body end of the neck the fretboard may be attached to the neck simply by slotting the male dovetail bar into the female dovetail groove formed in the neck and tapping them tight, thereby forming a friction fit.

If desired the fret may be of convex shape as viewed in transverse cross section.

Further, the neck may be formed of plastics, glassfibre, or other synthetic material that would have the advantage of increasing the strength whilst not being affected by humidity or age, or the neck and fretboard may be made as a single unit. A wooden neck would also be suitable provided that the neck and fretboard together are designed to accept the total string load.

Apart from the simplicity of fitting such fretboards, or replacing them, the working life should be considerably extended due to the surface wearing at a slower rate than conventional frets. Also the position of the frets may be determined with a precision accuracy which will not change with wear. The fretboard with an elongate stiffening bar will maintain its original flatness far better than conventional fretboards and will not be subject to changes due to humidity or temperature as much as conventional fretboards. The truss rod will not be needed, so adjustment and manufacture should be simplified.

Due to the cumulative effects of these factors, the height of the strings above the fretboard may be kept to a minimum for any mode of play. This will improve both the notation and the ease of play.

The accuracy of the fret positioning and the reduction in notational deviation caused by the string bending over the fret when it is being played will make any inaccuracy in frequency inaudible.

In another aspect of the present invention, there is provided a nut for a stringed instrument, the nut being of cylindrical form with annular grooves therein through which strings extend in use, the nut being so mounted or the grooves being so shaped that by rotating the nut the height of the strings above the surface of the fretboard, is varied.

Preferably the sides of the grooves diverge in a radially outwards direction to prevent the strings vibrating against the sides thereof.

Preferably the shape of each groove is that of a plane spiral so that the scale length is not varied when the nut is rotated about its longitudinal axis; therefore any height of the strings above the fretboard can be selected by the player to suit the mode of play.

Further, by having slightly different dimensions on the plane spirals, the strings may follow the curvature of the fretboard in the low position suitable for finger picking or strumming and in the high position may be in a flat plane suitable for Hawaiian or "bottleneck" style.

The cylindrical nut may be rotatably mounted in brackets at each end or in any other way so that it can rotate. It may be driven by a lever, or a worm gear and cog mounted at either end. The cog may be made as an integral part of the cylinder between the grooves, with the worm gear coming up through the base of the neck so that it meshes with the cog. This would have the advantage of keeping the weight down to a minimum, and it would reduce the change of accidental damage and make the drive mechanism as compact and efficient as possible.

A device similar to the cylindrical nut may be used in place of the bridge saddle, with arrangements for longitudinal displacement and adjustment.

In yet another aspect of the present invention there is provided a stringed instrument having a fretboard with a sawtooth profile and an elongate stiffening bar underneath, and a cylindrical nut rotatably mounted and adapted to vary the height and plane of the strings above the surface of the fretboard as the nut is rotated. If desired, the mounting for the nut is formed as an integral part of the fretboard.

Reference is made to the accompanying drawings in which FIGS. 1 to 3 show a portion of a conventional fretboard and FIGS. 4 to 12 illustrate an exemplary embodiment of the present invention.

In the drawings:

FIGS. 6 and 7 are the side and end elevations of a nut in accordance with another aspect of the present invention, showing the grooves for the strings, the integral cog and the axles which locate in the brackets shown in FIGS. 8 and 8A which are the side and end elevation of the brackets;

FIGS. 9, 10 and 11 are views showing various shapes of groove formed in the nut of a six string guitar;

Figure 1:
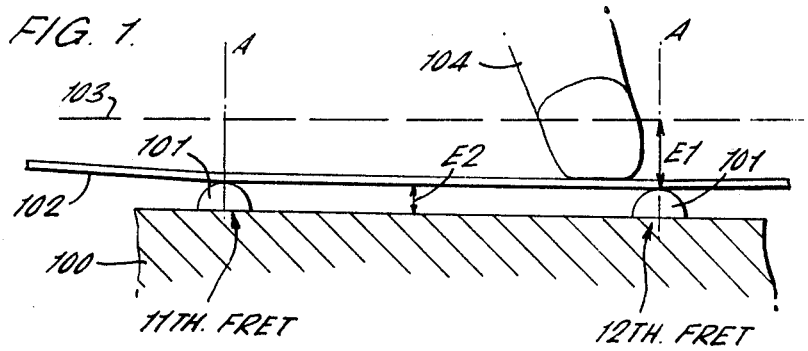
FIGS. 1 and 2 illustrate a portion of a conventional fretboard including the eleventh and twelth frets and the fingering thereof.
Figure 2:
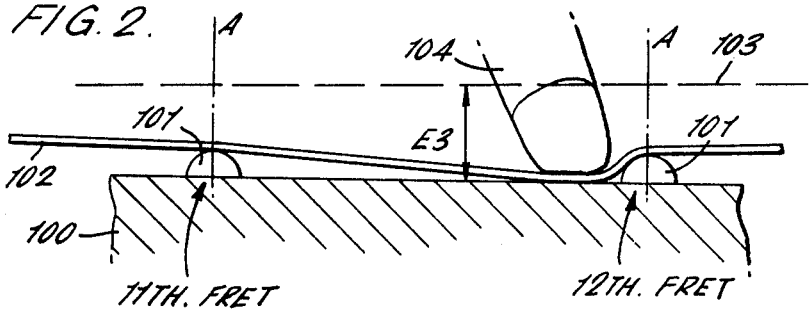

Referring to FIGS. 1 and 2, the surface profile of a conventional fretboard 100 is a flat surface with ridges or frets 101 at calculated intervals along its length. Notional or frequency deviation occurs when a string 102 is pressed from its rest of unfretted position shown by broken line 103 onto the fret by an instrument player's finger 104. Factors governing the frequency of the required note are shown in the following equation.

$$f = \frac{1}{2l}\sqrt{\frac{T}{m}}$$

where $f$ is the pitch or frequency $l$ is the vibrating length of a string $T$ is the tension on the string, and $m$ is the mass per unit length of the string When a string is in its rest or unfretted position 103, it is under a predetermined tension "$t$" in order that the correct frequency "$f$" be obtained. When the string is pressed down from its rest position into contact with the fret there is a corresponding increase in the value of "$t$" and therefore an increase in "$f$". This error is shown as E1 in FIG. 1.

In practice, when the string 102 is pushed down (or fretted) the situation shown in FIG. 2 is likely to occur. The string 102 is pushed a greater distance from its rest position and the error E2 in FIG. 1 further increases the value of "$t$" leading to a further increase of "$f$".

Although the distance of E1 in FIG. 1 is greater than E2, the effect of E2 on the tension is far greater. This is because the string is forced to bend around the fret 101 and under the finger 104, as shown in FIG. 2, causing it to follow a longer path, which results in an increase in "$t$" and hence in "$f$". This second error in practice tends to be approximately 10 times that of the first error, and in practical tests the second error was seldom less than a quater-tone.

Figure 3:
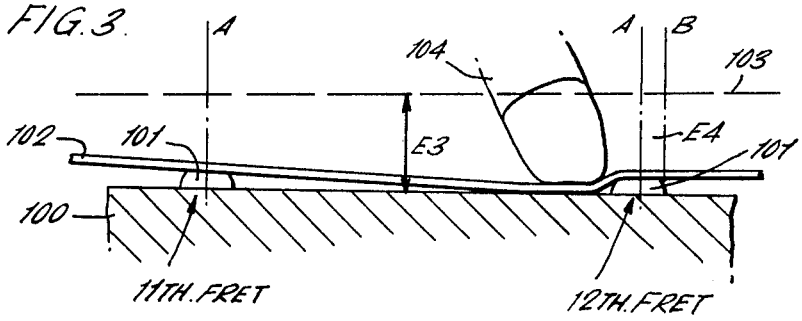
FIG. 3 is a view similar to FIG. 2 showing the effect of worn frets.

FIG. 3 indicates the situation in which the frets 101 are worn, the vertical lines "A" indicate the points from which the vibrating length "$l$" is calculated.

Due to the flattening of the fret, the string now leaves the fret at point B, causing the error E4 which decreases "$l$" which in turn increases "$f$" still further.

The sum of E3 plus E4 all working to increase the value of "$f$" cause changes of a quarter-tone to a semitone in the pitch of a note selected.

Referring to the above equation it must be noted that, due to the frequency doubling effect of a guitar top or resonator, the string is arranged to vibrate at half the frequency "$f$" of the required note. For example, an "A" string fretted at the 12th fret vibrates at 219.5 Hz but the body of the instrument produces a note of 439 Hz. Therefore, any error in the vibrating frequency of the string due to errors in fretting will be doubled in the same manner.

These changes in pitch represent a significantly audible deviation from the required note. Hence it is desirable to reduce or eliminate these errors in fretting.

FIGS. 4, 4A, 4B, 5A and 5B show a plan, side elevation, an enlarged section of the side elevation both end elevations of a fretboard 12 made in accordance with the present invention. The fretboard is made of a material which is both light and strong (such as the materials mentioned earlier) which must withstand the string tension without bending. As can be seen from the side and end views of the fretboard, an elongate bar 13 extends along part of the underside of the fretboard for increased strength and rigidity.

The elongate bar is set into a groove in the neck of the guitar (not shown). The fretboard may be screwed or glued to the neck. To speed up and simplify the assembly or removal of the fretboard from the neck, the elongate bar 13 may be made in the form of a male dovetail as shown in FIG. 5, and slotted into a female dovetail in the neck. By making the cross-sectional size of the female dovetail smaller at the end of the neck nearest the guitar body than at its other end, the fretboard may be held in position by a friction fit. If necessary small barbs may be incorporated on the sides of the elongate dovetail bar to prevent the fretboard from sliding along the neck away from the body.

Figure 4:
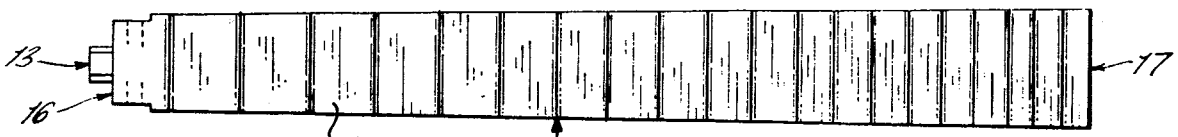
FIGS. 4 and 4A are the plan view and side elevation view of a fretboard made in accordance with the present invention.
Figure 4B:
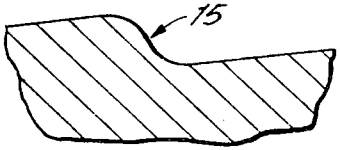
FIG. 4B is an enlarged segment of FIG. 4A showing a cross sectional side elevation of one fret; the vertical line shows the actual point of the fret position.
Figure 5B:
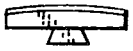
FIGS. 5A and 5B are left and right end views of the fretboard shown in FIG. 4.
Figure 5A:
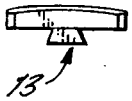
Figure 4A:
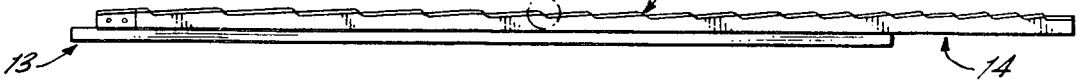

The upper surface of the fretboard has a plurality of ridges 15 of a sawtooth shape when viewed in the side elevation. The ridges are of increasing pitch from 16 to the end 17 which is attached to the body of the guitar. The vertical faces of the ridges 15 are rounded as shown in FIG. 4B.

The surface of the fretboard must be hard and smooth so that it is pleasant to play and wear is kept to a minimum, e.g. hard anodising on aluminum, or high carbon steel strips may be inserted into the crests of the ridges.

By using the sawtooth shaped profile, of the above construction the height of the strings above the fretboard may be permanently kept at the lowest and hence the fastest level regardless of normal humidity or temperature fluctuations. Notational deviation will be outside the range of human hearing, string wear will be reduced due to a greater area of string being in contact with the sawtooth profile, which allows the stress to be distributed over a wider area of both string and sawtooth fret; there will also be less opposition to the players fingers when moving swiftly up the fretboard.

Referring initially to FIG. 6 which shows details of a nut 26 which is preferably made from stainless steel, or a material having a similar degree of hardness and durability, and is formed from a cylindrical length of rod. The nut is rotatably mounted in end brackets shown in FIGS. 8 and 8A and has a cog 22 machined or cast into it so that it can be driven. The nut has six helical grooves numbered 1 to 6 for the strings (not shown), which are cut or cast in a wedge shape to prevent the strings vibrating against the sides of the grooves. The bases of the grooves are of various widths, as shown in FIG. 1, to accommodate various widths of strings, the groove 1 being the narrowest and the groove 6 being the widest. The cross sectional shape of each groove 1 to 6, that is, a section transverse to the longitudinal axis of the nut 26, is in the form of a plane spiral or snail cam in that the root of each groove increases progressively from a minimum to a maximum radius. The shapes of the grooves are arranged in matched pairs, and on the drawings the matched pairs are the grooves 1 and 6, 2 and 5, and 3 and 4. Although the pairs of grooves have similar shapes they have different root dimensions and taking the cross sectional views shown in FIGS. 9 to 11 as a specific example the dimensions in millimeters are as follows, starting at the maximum radius and taking three other points X, Y, Z angularly spaced from each other in a clockwise direction by 90°.

| FIG. | Grooves | Max. Radii | Posn. X | Posn. Y | Posn. Z |
|---|---|---|---|---|---|
| 9 | 3,4 | 5.8 | 5.132 | 4.466 | 3.8 |
| 10 | 2,5 | 5.8 | 5.067 | 4.334 | 3.6 |
| 11 | 1,6 | 5.8 | 4.9 | 4.0 | 3.1 |

The overall diameter of the nut is 13.6 mm.

Although the nut 26 is preferably made from a single length of stainless steel rod, it may comprise a splined shaft having a plurality of snail cams of suitable shape which are spaced apart on the shaft by spacer members non-rotatably mounted on the shaft. In a further embodiment of the nut it may comprise a grooved cylinder which is eccentrically mounted whereby rotation of the nut will cause the height of the strings to be varied.

At each end of the nut is a stub axle 8 which fits rotatably in the brackets 9 which are shown in side and end elevation in FIGS. 8 and 8A. Screw holes 10 are provided in the brackets 9 through which fastening screws (not shown) pass.

Figure 12:
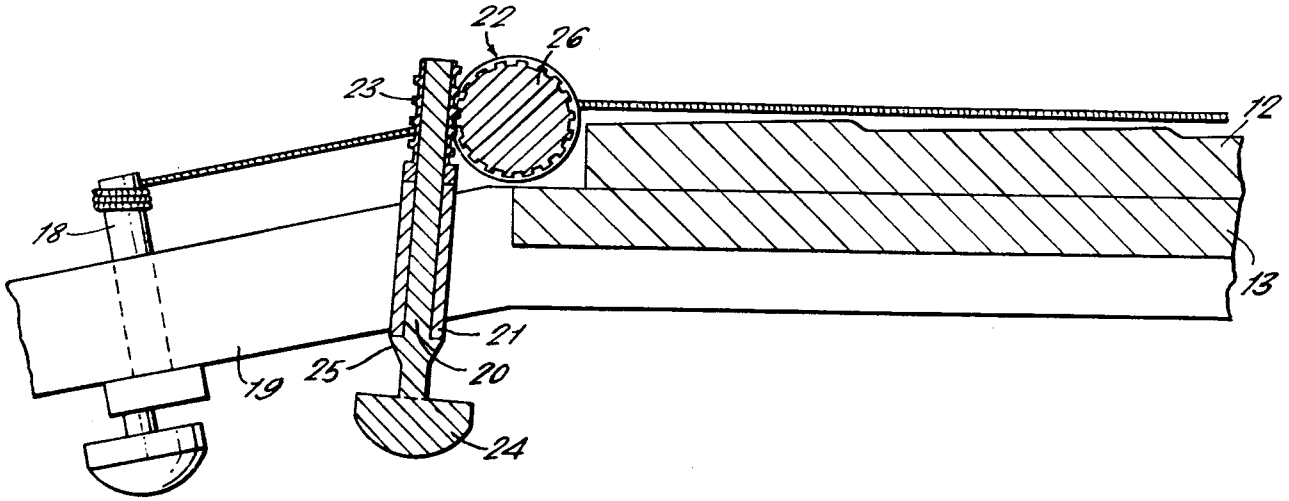
FIG. 12 is a cross sectional side elevation of the end of the neck and fretboard, showing one machine head and an embodiment of one driving mechanism for the nut.

The nut 26 is driven by the cog 22 which meshes with a worm gear 23 as shown in FIG. 12. The worm gear 23 is mounted on the head of a shaft 20 running up through a sleeve 21 which is set at an angle through the head 19 of a guitar. Thus the nut 26 may be rotated by turning the turn pin or head 24 on the end of the shaft 20. A shoulder 25 is provided on the shaft 20, the shoulder 25 bears against the lower end of the sleeve 21. For convenience the turn pin 24, the shaft 20 and the shoulder 25 may be formed as a single unit. The turn pin may also be formed as a crank handle for faster adjustment.

Although other methods of driving the nut may be used, such as a lever on the end of the nut, or a worm gear and cog mounted at either end of the nut, the advantages of the above method are that the player has a fine adjustment of the string height, and the nut will then be held securely in position. Also there is nothing at either end of the nut to obstruct the players hand.

By using the rotating cam nut 26 in conjunction with a fretboard having a sawtooth profile a player may easily adjust the height and plane of the strings relative to the fretboard for the optimum in any mode of play and at the same time obtain a greater notational accuracy.

I claim:

1. A fretboard adapted to be fitted to the neck of a stringed instrument, the fretboard comprising a unitary, elongate body having first and second longitudinally spaced ends to be arranged adjacent the body and head ends, respectively, of a stringed instrument, and a plurality of integrally formed frets in the normal fret positions, said frets comprising transversely extending crests of a plurality of triangular shaped ridges arranged in succession along a surface of said body from said first end to said second end, each said ridge comprising a relatively short side inclined substantially at right angles to the longitudinal axis of said body and a relatively long, substantially planar side sloping from the top of said short side to the base of the short side of the next following ridge in the direction of said second end, the top of each said short side where it meets its associated relatively long side, being rounded with the center of curvature located on an imaginary line extending substantially at right angles to the longitudinal axis of said body and passing through the crest of the associated ridge, at least the crest of each ridge having a hard, wear resistant surface.

2. A fretboard as claimed in claim 1, wherein said fretboard is of a metallic material.

3. A fretboard as claimed in claim 1, wherein said fretboard is of a high impact plastics material.

4. A fretboard as claimed in claim 1, comprising in addition, an elongate stiffening bar extending along a surface of said fretboard opposite said surface having said sawtooth profile.

5. A fretboard as claimed in claim 1 wherein each of said teeth is of convex shape, when viewed in cross-section.

6. In a stringed instrument comprising a body, a head, a neck interconnecting said head and said body, a fretboard mounted on said neck, and a plurality of strings extending from said body to said head, the improvement comprising the surface of said fretboard having a plurality of integrally formed frets in the normal fret positions, said frets comprising transversely extending crests of a plurality of triangular shaped ridges arranged in succession along a surface of said fretboard from said head to said body, each said ridge comprising a relatively short side inclined substantially at right angles to the longitudinal axis of said fretboard and a relatively long, substantially planar side sloping from the top of said short side to the base of the short side of the next following ridge in the direction of said head, the top of each said short side where it meets its associated relatively long side, being rounded with the centre of curvature located on an imaginary line extending substantially at right angles to the longitudinal axis of said body and passing through the crest of the associated ridge, at least the crest of each ridge having a hard, wear resistant surface.

7. An instrument as claimed in claim 6, comprising in addition, an elongate stiffening bar extending along the underside of said fretboard, and a groove in said neck for receiving said stiffening bar.

8. An instrument as claimed in claim 7, wherein said stiffening bar is of male dovetail cross sectional shape.

9. In a stringed instrument comprising a body, a head, a neck interconnecting said head and said body, a fretboard mounted on said neck, and a plurality of strings extending from said body to said head, the improvement comprising the surface of the fretboard which has a sawtooth profile extending longitudinally of the fretboard with the transversely extending crests of the teeth in the normal fret positions, and a rotatably mounted nut positioned intermediate said neck and said head, said nut being of generally cylindrical form and having a plurality of grooves therein, one groove for each said string of the instrument a core of each groove being in the form of a plane spiral, the radius of which increases progressively from a minimum radius to a maximum radius in substantially 360° of revolution, whereby on rotation of said nut, the heights of said strings from said surface of said fretboard are varied simultaneously.

10. An instrument as claimed in claim 9, wherein walls of said grooves diverge in a radially outwards direction.

11. An instrument as claimed in claim 9, comprising, in addition, means for rotating said nut.

12. An instrument as claimed in claim 11, wherein said means comprises a cog on said nut and a worm gear mounted to mesh with said cog.

13. An instrument as claimed in claim 9, wherein said nut comprises a unitary member.

14. An instrument as claimed in claim 13, comprising, in addition, means to rotate said nut.

15. In a stringed instrument comprising a body, a head, a neck interconnecting said head and said body, a fretboard mounted on said neck, a nut positioned intermediate said neck and said head, and a plurality of strings extending under tension from said body, over said nut, to said head, the improvement comprising that said nut is rotatably mounted and is of generally cylindrical form having a plurality of annular grooves therein, one groove for each said string, a core of each groove being in the form of a plane spiral, the radius of which increases progressively from a minimum radius to a maximum radius in substantially 360° of revolution, whereby on rotation of said nut, the height of said strings from the surface of said fretboard are varied simultaneously.

16. An instrument as claimed in claim 15, wherein there are six grooves arranged in matched pairs.

* * * * *